US008401762B2

(12) United States Patent
Asano et al.

(10) Patent No.: US 8,401,762 B2
(45) Date of Patent: Mar. 19, 2013

(54) ENGINE CONTROL SYSTEM WITH ALGORITHM FOR ACTUATOR CONTROL

(75) Inventors: Masahiro Asano, Kariya (JP); Yoshimitsu Takashima, Anjo (JP); Koji Ishizuka, Aichi-ken (JP); Satoru Sasaki, Kariya (JP); Kazuhiro Higuchi, Ichinomiya (JP); Sumitaka Ikeda, Anjo (JP); Youhei Morimoto, Kariya (JP); Mitsuhiro Nishimura, Chiryu (JP)

(73) Assignee: Denso Corporation, Kariya (JP)

( * ) Notice: Subject to any disclaimer, the term of this patent is extended or adjusted under 35 U.S.C. 154(b) by 347 days.

(21) Appl. No.: 12/917,659

(22) Filed: Nov. 2, 2010

(65) Prior Publication Data

US 2011/0106399 A1 May 5, 2011

(30) Foreign Application Priority Data

Nov. 2, 2009 (JP) ..... 2009-251866

(51) Int. Cl.
*F02M 51/00* (2006.01)

(52) U.S. Cl. ..... 701/102; 123/406.23; 123/406.26; 123/406.44; 123/480

(58) Field of Classification Search ..... 701/101–110; 123/406.21, 406.23–406.29, 406.37, 406.41–406.48, 123/435, 480, 674, 679; 60/295, 301, 285, 60/286

See application file for complete search history.

(56) References Cited

U.S. PATENT DOCUMENTS 4,556,030 A 12/1985 Aono
5,023,795 A * 6/1991 Matsumura et al. ..... 701/104
5,495,835 A * 3/1996 Ueda ..... 123/339.11
5,541,844 A * 7/1996 Ibaraki et al. ..... 701/102
5,951,618 A * 9/1999 Fukuchi et al. ..... 701/110
6,449,943 B1 * 9/2002 Ueno et al. ..... 60/274
6,478,015 B2 * 11/2002 Oki et al. ..... 123/520
6,761,138 B2 * 7/2004 Takahashi et al. ..... 123/90.15
6,928,361 B2 * 8/2005 Nakayama et al. ..... 701/104
6,994,077 B2 * 2/2006 Kobayashi et al. ..... 123/568.11
7,163,007 B2 1/2007 Sasaki et al.

(Continued)

FOREIGN PATENT DOCUMENTS

JP S59-136544 8/1984
JP H10-026047 1/1998

(Continued)

OTHER PUBLICATIONS

Japanese Office Action dated Aug. 30, 2011, issued in corresponding Japanese Application No. 2009-251866 with English Translation.

*Primary Examiner* — Stephen K Cronin
*Assistant Examiner* — Joseph Dallo
(74) *Attorney, Agent, or Firm* — Nixon & Vanderhye PC

(57) ABSTRACT

An engine control apparatus which may be employed in automotive vehicles. The engine control apparatus is equipped with a controlled variable arithmetic expression which defines correlations between combustion parameters associated with combustion conditions of an engine and controlled variables actuators for an operation of the engine. This eliminates the need for finding relations of optimum values of the controlled variables to the combustion parameters through adaptability tests, which results in a decrease in burden of an adaptability test work and a map-making work on manufacturers. The engine control apparatus also works to learn or optimize the controlled variable arithmetic expression based on actual values of the combustion parameters, thereby avoiding undesirable changes in correlations, as defined by the controlled variable arithmetic expression, due to a change in environmental condition.

8 Claims, 7 Drawing Sheets

U.S. PATENT DOCUMENTS

| | | | | |
|---|---|---|---|---|
| 7,454,286 | B2 * | 11/2008 | Sinnamon et al. | 701/110 |
| 2005/0229903 | A1 | 10/2005 | Kobayashi et al. | |
| 2008/0077304 | A1 * | 3/2008 | Suzuki et al. | 701/102 |
| 2008/0228383 | A1 | 9/2008 | Nakagawa et al. | |
| 2008/0314369 | A1 * | 12/2008 | Takakura et al. | 123/520 |
| 2009/0164090 | A1 * | 6/2009 | Yasui et al. | 701/102 |
| 2009/0198430 | A1 * | 8/2009 | Yasui et al. | 701/102 |
| 2009/0319157 | A1 * | 12/2009 | Ishizuka | 701/106 |

FOREIGN PATENT DOCUMENTS

| | | |
|---|---|---|
| JP | 2002-138889 | 5/2002 |
| JP | 2004-100566 | 4/2004 |
| JP | 2005-248703 | 9/2005 |
| JP | 2006-029171 | 2/2006 |
| JP | 2007-077935 | 3/2007 |
| JP | 2008-223643 | 9/2008 |

* cited by examiner

| | A IGNITION TIMING | B | C |
|---|---|---|---|
| INJECTION QUANTITY | | | |
| INJECTION DURATION | | | |
| EGR AMOUNT | | | |

| | NOx | CO | FUEL CONSUMPTION |
|---|---|---|---|
| A IGNITION TIMING | | | |
| B | | | |
| C | | | |

ENGINE CONTROL SYSTEM WITH ALGORITHM FOR ACTUATOR CONTROL

CROSS REFERENCE TO RELATED DOCUMENT

The present application claims the benefit of priority of Japanese Patent Application No. 2009-251866 filed on Nov. 2, 2009, the disclosures of which are incorporated herein by reference.

BACKGROUND OF THE INVENTION

1. Technical Field of the Invention

The present invention relates generally to an engine control system which may be employed in automotive vehicles and is designed to use an algorithm to control operations of actuators such as a fuel injector and an EGR (Exhaust Gas Recirculation) valve to regulate a combustion condition of fuel in an internal combustion engine and also to control output characteristics of the engine.

2. Background Art

Engine control systems are known which determine controlled variables such as the quantity of fuel to be injected into an engine (which will also be referred to as an injection quantity), the injection timing, the amount of a portion of exhaust gas to be returned back to the inlet of the engine (which will also be referred to as an EGR amount below), the boost pressure (also called supercharging pressure), the amount of intake air, the ignition timing, and an open/close timing of intake and exhaust valves to bring engine output-related values such as the amount of exhaust emissions, for example, NOx or CO, the torque outputted by the engine, and the specific fuel consumption (or fuel efficiency) into agreement with required values.

For example, Japanese Patent First Publication Nos. 2008-223643 and 2007-77935 disclose the above type of engine control systems which calculate a target value of pressure in a cylinder of the engine (i.e., a combustion parameter) based on a value of torque the engine is required to output and adjust the open/close timing of the intake and exhaust valves and the quantity of fuel to be injected into the engine (i.e., controlled variables of actuators) so as to bring the in-cylinder pressure into agreement with the target value.

The above engine control systems have the drawback in that correlations between the engine output-related values and the controlled values usually change with a change in environmental is condition such as the temperature of outside air or due to an individual variability of the engine, which will result in deviations between the engine output-related values from the required values.

The problem may be eliminated by learning changes in correlations between the engine output-related values and the controlled variables depending upon the change in environmental condition. This, however, requires the measurement of emissions from the engine such as NOx or PM, the output torque from the engine, the fuel consumption in the engine, or noises arising from combustion of fuel in the engine (i.e., the engine output-related values), thus resulting in a great increase in cost to install the system in automotive vehicles. In order to alleviate this problem, some of the engine control systems are designed to correct the correlations between the engine output-related values and the controlled variables so as to compensate for changes therein with a change in environmental condition of the engine using a correction map or learning only the correlations associated with the measurable engine output-related values. The making of the correction map requires lots of data on correspondence between the engine output-related values and the controlled variables under environmental conditions that the correlations are needed to be corrected, thus imposing a heavy burden on control system manufacturers or resulting in possibility of a difficulty in bringing all the engine output-related values into agreement with required values thereof.

Moreover, some of the engine output-related values can be measured using vehicle-installed sensors directly (e.g., the measurement of NOx using a NOx sensor) or indirectly (e.g., the measurement of PM using an A/F sensor) in order to learning the correlations between the engine output-related values and the controlled variables partially, however, the problem is encountered in that when the responsiveness of the sensors is low undesirably, the partial learning needs to be made only in a limited condition, for example, where the engine is running in the steady state.

SUMMARY OF THE INVENTION

It is therefore a principal object of the invention to provide an engine control apparatus constructed to decrease a burden on the adaptability test work and map-making work and improve the controllability in bringing output-related values into agreement with required values.

It is another object of the invention to an engine control apparatus designed to ensure high accuracy in bringing engine output-related values into agreement with required values with fewer measurement features such as sensors.

According to one aspect of the invention, there is provided an engine control apparatus which may be employed in automotive vehicles. The engine control apparatus comprises: (a) a combustion target value calculator which uses a combustion parameter arithmetic expression defining a correlation between at least one engine output-related value indicating an output characteristic of an internal combustion engine and at least one combustion parameter associated with a combustion condition of the internal combustion engine to calculate a target value of the combustion parameter needed to meet a required value of the engine output-related value; (b) a controlled variable command value calculator which uses a controlled variable arithmetic expression defining a correlation between the combustion parameter and at least one controlled variable of at least one actuator to calculate a command value representing a target value of the controlled variable to achieve the target value of the combustion parameter, the actuator being operable to control the combustion condition of the internal combustion engine based on the command value; (c) a combustion condition determiner which determines an actual value of the combustion parameter; and (d) a learning circuit which performs a learning operation to learn the correlation between the combustion parameter and controlled variable based on the actual value of the combustion parameter to update the controlled variable arithmetic expression.

The controlled variable arithmetic expression, as described above, defines the correlation between the combustion parameter and the controlled variable of the actuator. The agreement of an actual value of the combustion parameter with a target value thereof may, therefore, be achieved by controlling the operation of the actuator to achieve the required value of the controlled variable, as derived by substituting the target value of the combustion parameter into the controlled variable arithmetic expression. In other words, the controlled variable arithmetic expression expresses how to operate the actuator to meet desired combustion condition of the engine. The target value of the combustion parameter is, therefore, achieved by determining the command value based on a value calculated from the controlled variable arithmetic expression and outputting the command value to the actuator. The controlled variable arithmetic expression may be implemented by a determinant, as illustrated in FIG. 1(*c*), or a model, as illustrated in FIG. 1(*a*).

The combustion parameter target value calculator uses the controlled parameter arithmetic expression to determine a target combustion condition of the engine (i.e., the target value of the combustion parameter). The required value of the engine output-related value is, therefore, achieved by controlling the engine to have the target combustion condition, i.e., to meet the target value of the combustion parameter.

The combustion parameter arithmetic expression, as described above, defines the correlation between the engine output-related value and the combustion parameter. The agreement of an actual value of the engine output-related value with a required value thereof may, therefore, be achieved by bringing the combustion condition of the internal combustion engine toward a value of the combustion parameter, as derived by substituting the required value of the engine output-related value into the combustion parameter arithmetic expression. In other words, the combustion parameter arithmetic expression describes a relationship of the combustion condition in which the internal combustion engine is to be placed to have the engine output-related value. The required value of the engine output-related value is, therefore, achieved by determining a value calculated from the combustion parameter arithmetic expression as the target value of the combustion parameter and controlling an operation of the actuator to meet the target value. The combustion parameter arithmetic expression may be implemented by a determinant, as illustrated in FIG. 1(*b*), or a model, as illustrated in FIG. 1(*a*).

As apparent from the above discussion, the engine control apparatus works to use the combustion parameter arithmetic expression and the controlled variable arithmetic expression to define the correlation between the engine output-related value and the combustion parameter and between the combustion parameter and the controlled variable, thereby figuring out how to operate the actuator to derive a desired combustion condition of the engine and finding the combustion condition in relation to the output condition of the engine. This means that the combustion parameter is used as an intermediate parameter to obtain the correlation between the engine output-related value and the controlled variable. The simultaneous agreement of the engine output-related value with the required value thereof is, therefore, achieved by calculating the target value of the combustion parameter based on the required value of the engine output-related value through the combustion parameter arithmetic expression, producing the command value for the controlled variable which corresponds to the calculated target value through the controlled variable arithmetic expression, and controlling the operation of the actuator through the command value.

A relationship between the controlled variable and the engine output-related value may change with a change in environmental condition such as the temperature of coolant of the engine or the outside air temperature or due to aging of the engine, thereby resulting in a change in correlation between the combustion parameter and the controlled variable, as defined by the controlled variable arithmetic expression. The correlation between the engine output-related value and the combustion parameter, as defined by the combustion parameter arithmetic expression, is heavily dependent upon the characteristic of the engine, but less dependent upon a change in environmental condition. The inventors of this application focused their attention on such a dependency difference between the controlled variable arithmetic expression and the combustion parameter arithmetic expression and designed the engine control apparatus to have the learning circuit which learns or update the controlled variable arithmetic expression based on the actual value of the combustion parameter, as determined by the combustion parameter determiner. This improves the accuracy in determining the controlled variable of the actuator through the controlled variable arithmetic expression which is sensitive to a change in environmental condition and ensures the stability in bringing the engine output-related value into agreement with the required value.

In the case where the engine output-related value is detected by, for example, a NOx sensor to learn the correlation between the engine output-related value and the controlled variable, such learning needs to be done only in the condition where the NOx sensor is sufficiently sensitive to a change in concentration of NOx in emissions from the engine, for example, when the engine is running in the steady state because the responsiveness of the NOx sensor is usually low. It also costs so much to learn the correlation. In contrast, it is usually faster to detect the combustion parameter using the combustion condition determiner n lots of learnable conditions. It is also easy to learn the correlation between the controlled variable and the combustion parameter completely. The learning of the controlled variable arithmetic expression is very effective in ensuring the accuracy in brining the engine output-related value into agreement with a required value.

The combustion condition determiner which determines the an actual value of the combustion parameter for use in learning the controlled variable arithmetic expression may be implemented by a physical sensor or an arithmetic model.

In the preferred mode of the invention, the learning operation of said learning circuit may be permitted to commence during a steady state operation of the internal combustion engine in which a rate of change in actual value of the combustion parameters, as determined by said combustion condition determiner, is stabilized within a given value, while the learning operation may be prohibited from commencing during a transient state operation of the internal combustion engine in which the rate of change is greater than the given value.

The measurement of the combustion parameter can usually be made faster than that of the engine output-related value. The measurement lag or measurement error will arise depending upon the type of a means used as the combustion parameter determiner, thus resulting in deterioration in learning the controlled variable arithmetic expression. This problem may be alleviated by performing the learning operation when the internal combustion engine is running in the steady state.

The learning operation may be made when the internal combustion engine is in the transient state. In this case, a greater weighting factor may be used in updating the controlled variable arithmetic expression based on the actual value of the combustion parameter, sampled during a steady state operation of the internal combustion engine in which a rate of change in actual value of the combustion parameter is stabilized within a given value, while a smaller weighting factor may be used in updating the controlled variable arithmetic expression based on the actual value of the combustion parameter, sampled during a transient state operation of the internal combustion engine in which the rate of change is greater than the given value. This minimizes the deterioration in learning or updating the controlled variable arithmetic expression and also permits the number of times the learning operation is made to be increased as compared with when the learning operation is prohibited from commencing during the transient state of the internal combustion engine.

The combustion condition determiner may be calibrated during running of the internal combustion engine. The learning operation may be permitted to commence when a time elapsed since calibration of the combustion condition determiner is completed is within a predetermined time limit, while the learning operation may be prohibited from commencing when the elapsed time is out of the predetermined time limit.

For example, in the case where the combustion condition determiner is implemented by a cylinder pressure sensor which measures the pressure in a cylinder of the internal combustion engine, the calibration is made based on a deviation of an output of the cylinder pressure senor when the internal combustion engine is in a condition where the pressure in the cylinder would be the atmospheric pressure, e.g., at the time when an ignition switch is turned on from the atmospheric pressure.

The high accuracy of the combustion parameter determiner is usually ensured as immediately as possible after the completion of the calibration of the combustion condition determiner. In view of this, the engine control apparatus permits the learning operation to commence when the time elapsed since the calibration of the combustion condition determiner is completed is within the predetermined time limit and prohibits it from commencing when the elapsed time is out of the predetermined time limit.

Alternatively, the learning operation may be made after the lapse of the time limit. In this case, it is preferable that a greater weighting factor is used in updating the controlled variable arithmetic expression based on the actual value of the combustion parameter, as sampled within the predetermined time limit, while a smaller weighting factor is used in updating the controlled variable arithmetic expression based on the actual value of the combustion parameter, as sampled after the lapse of the predetermined time limit.

The combustion condition determiner may be implemented by a cylinder pressure sensor which measures the pressure in a cylinder of the internal combustion engine. In this case, the ignition timing which correlates with the engine output-related value such as emissions (e.g., NOx) from the engine or the torque outputted by the engine may be used as the combustion parameter.

The controlled variable arithmetic expression may be made to define correlations between different types of combustion parameters and different types of controlled variables of actuators. The controlled variable command value calculator determines a combination of command values needed to achieve target values of the combustion parameters through the controlled variable arithmetic expression.

The controlled variable arithmetic expression may also be made to define correlations of the ignition timing, the ignition delay, etc., (i.e., the combustion parameters) and the injection quantity, the EGR amount, the supercharging pressure, etc. (i.e., the controlled variables). In other words, the controlled variable arithmetic expression does not define a one-to-one correspondence between, for example, the ignition timing and the injection quantity, but shows how to select a combination of, for example, the injection quantity, the EGR amount, and the supercharging pressure to meet all target values of the ignition timing and the ignition delay. Basically, the controlled variable arithmetic expression is made to define a given number of or all possible combinations of the controlled variables with the combustion parameters which are needed to achieve the target values of the combustion parameters.

The engine control apparatus, as described above, may work to use the controlled variable arithmetic expression to calculate a combination of the command values for the controlled variables which corresponds to target values of the combustion parameters, thus eliminating the need for finding relations of optimum values of the controlled variables to the combustion parameters through the adaptability tests, which results in a decrease in burden of the adaptability test work and the map-making work on manufacturers.

If the command values for the controlled variables in relation to the combustion parameters are determined independently of each other, it may result in the following mutual interference. Specifically, when one of the combustion parameters which corresponds to the command value for one of the controlled variables has reached a target value thereof, another combustion parameter deviates from a target value thereof, while when the another combustion parameter is brought into agreement with the target value thereof, the one of the combustion parameters deviates from the target value thereof. In contrast, the engine control apparatus calculates a combination of the command values for the controlled variables which correspond to target values of the combustion parameters and controls the operation of the actuators based on the combination of the command values, thus avoiding the deterioration of the controllability arising from the mutual interference between the combustion parameters and attaining the simultaneous agreement of the combustion parameters with the target values thereof, which results in an improvement of the controllability of the engine control apparatus.

The engine control apparatus may further include a combustion parameter feedback circuit which feeds a deviation of the actual value of the combustion parameter from the target value thereof back to the calculation of the command value for the controlled variable.

When the learning operation is performed properly, it will result in no deviation of the actual value of the combustion parameter from the target value thereof. The learning can't, however, always be made at all times. The risk of erroneous learning is also increased depending upon conditions to start the learning. Therefore, the engine control apparatus starts to learn the controlled variable arithmetic expression only when the condition in which the risk of the erroneous learning is low is met. This keeps good ability of the engine control apparatus. After the learning operation is completed, the time required to bring the actual value of the combustion parameter into agreement with the target value in the feedback mode will be shortened.

The combustion parameter arithmetic expression may define correlations between different types of engine output-related values and different types of combustion parameters. The combustion target value calculator determines a combination of target values of the combustion parameters for meeting required values of the engine output-related values through the combustion parameter arithmetic expression.

The combustion parameter arithmetic expression may define the correlations between, for example, the amount of NOx, the amount of PM (Particulate Matter), the output torque of the engine, etc. (i.e. the engine output-related values) and, for example, the ignition timing, the ignition delay, etc. (i.e., the combustion parameters). In other words, the combustion parameter arithmetic expression does not define a one-to-one correspondence between the engine output and the ignition timing, but defines a combination of values of the ignition timing and the ignition delay which are needed to meet the required values of all the output torque, the amount of NOx, and the amount of PM.

The combustion parameter arithmetic expression may be made to define a given number or all possible combinations of the combustion parameters (e.g., the ignition timing and the ignition delay) with the engine output-related values (e.g., the output torque, the amount of NOx, and the amount of PM) which are needed to achieve the required values of the engine output-related values.

The engine control apparatus, as described above, may work to use the combustion parameter arithmetic expression to calculate a combination of target values of the combustion parameters which correspond to required values of the engine output-related values and calculate the command values for the actuators which are required to meet the combination of the target values. This eliminates, unlike in the publications, as referred to in the introductory part of this application, the need for finding relations of optimum values of the combustion parameters to the engine output-related values through the adaptability tests, thus decreasing a burden of the adaptability test work and the map-making work on manufacturers of the engine control apparatus.

If target values of the combustion parameters in relation to the engine output-related values are determined independently of each other, it may result in the following mutual interference. Specifically, when one of the engine output-related values which corresponds to the target value of one of the combustion parameters reaches its required value, another engine output-related value deviates from its required value, while when another engine output-related value is brought into agreement with its required value, the previously mentioned one of the engine output-related values deviates from its required value. It is, therefore, very difficult to bring the different types of engine output-related values into agreement with target values simultaneously. In contrast, the engine control apparatus calculates a combination of target values of the combustion parameters which correspond to required values of the engine output-related values and controls the operations of the actuators so as to achieve the target values, thus avoiding the deterioration of the controllability arising from the mutual interference between the combustion parameters and attaining the simultaneous agreement of the engine output-related values with the required values thereof, which results in an improvement of the controllability of the engine control apparatus.

The engine control apparatus may use the combustion parameter arithmetic expression and the controlled variable arithmetic expression to define the correlations between the different types of engine output-related values and the different types of combustion parameters and between the different types of combustion parameters and the different types of controlled variables, thereby figuring out how to operate the actuators to derive desired combustion conditions of the engine and finding the combustion conditions in relation to the output conditions of the engine. This means that the combustion parameters are used as intermediate parameters to obtain the correlations between the engine output-related values and the controlled variables.

The simultaneous agreement of the engine output-related values with the required values thereof is, therefore, achieved by calculating the target values of the combustion parameters based on the required values of the engine output-related values through the combustion parameter arithmetic expression, producing command values for the controlled variables which correspond to the calculated target values through the controlled variable arithmetic expression, and controlling the operations of the actuators through the command values.

The engine control apparatus may further include an engine output feedback circuit which feeds a deviation of the actual or calculated value of the engine output-related value from the required value thereof back to calculation of the target value of the combustion parameters.

The corrections representing the combustion condition of the engine (i.e., the combustion parameter) needed to bring the output condition of the engine (i.e., the engine output-related value) is less dependent upon a change in environmental condition such as the temperature of coolant for the engine or the temperature of outside air, but may be changed by the individual variability or aging of the engine. The engine control apparatus is, therefore, designed to have the engine output feedback circuit which feeds the deviation of the actually measured or calculated value of the engine output-related value from the required value back to the calculation of target value of the combustion parameter. This ensures good controllability of the engine control system.

The engine output-related values may represent at least two of a physical quantity associated with an exhaust emission from the internal combustion engine, a physical quantity associated with an output torque of the internal combustion engine, a physical quantity associated with a fuel consumption, and a physical quantity associated with combustion noise of the internal combustion engine.

For instance, the physical quantity associated with the exhaust emission is the amount of NOx, the amount of PM, the amount of CO, or the amount of HC. The physical quantity associated with the output torque of the engine is the torque outputted from the engine itself or the speed of the engine. The physical quantity associated with the combustion noise is a combustion noise itself or mechanical vibrations of the engine. Such various kinds of physical quantities may be exemplified as the engine output-related values and broken down roughly into the exhaust emission, the output torque, the fuel consumption, and the combustion noise. These four kinds of engine output-related values are disposed to interfere with each other. The engine control apparatus is, therefore, very effective in treating such engine output-related values.

The engine output-related values may also include at least two of the amount of NOx, the amount of PM, the amount of CO, and the amount of HC. The engine output-related values associated with such exhaust emissions are more likely to have the tradeoff relationship. The engine control apparatus is, therefore, effective in treating such engine output-related values.

The combustion parameters may include the ignition timing and the ignition delay. Such kinds of combustion parameters are typical physical quantities representing the combustion conditions in a cylinder of the engine and related closely with each other. The use of the combustion parameter arithmetic expression and the controlled variable arithmetic expression, therefore, minimizes the mutual interference between such combustion parameters.

The controlled variables may include at least two of the injection quantity of fuel, the injection timing of fuel, the number of injections of fuel, the supply pressure of fuel, the EGR amount, the supercharging pressure, and the open/close timing of intake or exhaust valve. Such controlled variables are typical variables used in the engine control system and more likely to interfere mutually with each other. The use of the controlled variable arithmetic expression, therefore, minimizes the mutual interference between such controlled variables.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 1(*b*) is an illustration which represents a determinant used as a combustion parameter arithmetic expression;

FIG. 1(*c*) is an illustration which represents a determinant used as a controlled variable arithmetic expression;

FIG. 3(*b*) is an illustration which exemplifies the correlation, as defined by the controlled variable arithmetic expression of FIG. 3(*a*);

FIG. 3(*c*) is an illustration which exemplifies the correlation, as defined by the combustion parameter arithmetic expression of FIG. 3(*a*);

FIG. 5(*b*) is a view which exemplifies a change in temperature of coolant of an internal combustion engine;

FIG. 5(*c*) is a view which exemplifies changes in combustion parameters;

FIG. 5(*d*) is a view which exemplifies changes in engine output-related values.

DESCRIPTION OF THE PREFERRED EMBODIMENTS

Figures 1A, 1B, 1C:
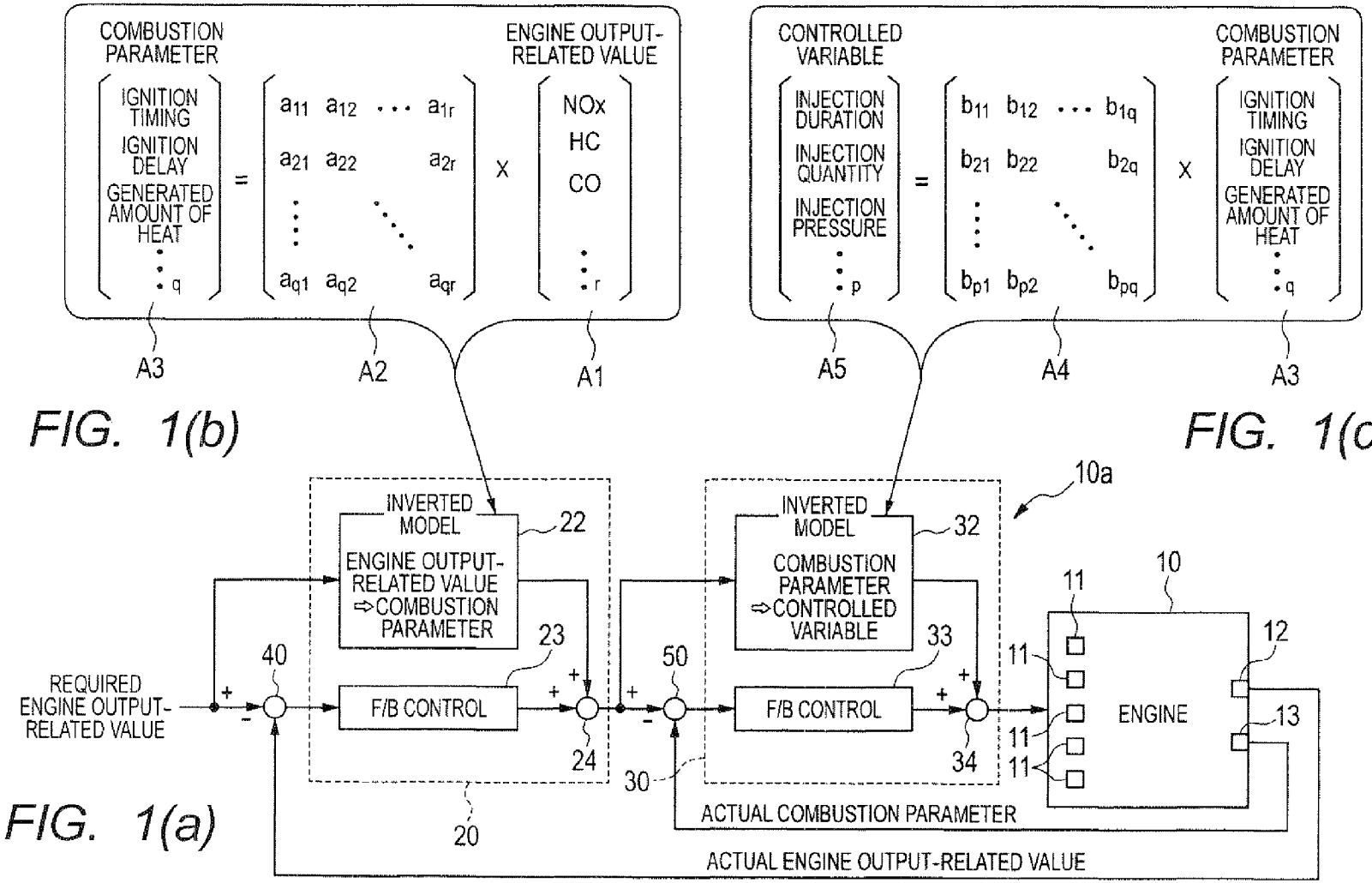
FIG. 1(*a*) is a block diagram which shows an engine control system according to the first embodiment.

Referring to the drawings, wherein like reference numbers refer to like parts in several views, particularly to FIG. 1(*a*), there is shown an engine control system according to the first embodiment which is designed to control an operation of an internal combustion engine 10 for automotive vehicles. The following discussion will refer to, as an example, a self-ignition diesel engine in which fuel is sprayed into four cylinders #1 to #4 at a high pressure.

FIG. 1(*a*) is a block diagram of the engine control system implemented by an electronic control unit (ECU) 10*a* which works to control operations of a plurality of actuators 11 to regulate fuel combustion conditions of the engine 10 for bringing output characteristics of the engine 10 into agreement with desired ones.

The actuators 11 installed in a fuel system are, for example, fuel injectors which spray fuel into the engine 10 and a high-pressure pump which controls the pressure of fuel to be fed to the fuel injectors. The ECU 10*a* works to calculate a command value representing a target controlled variable, i.e., a target amount of fuel to be sucked and discharged by the high-pressure pump and output it in the form of a command signal to the high-pressure pump to control the pressure of fuel to be sprayed into the engine 10. The ECU 10*a* also determines command values representing target controlled variables, i.e., a target quantity of fuel to be sprayed from each of the fuel injectors (i.e., an injection duration), a target injection timing at which each of the fuel injectors is to start to spray the fuel, and the number of times each of the fuel injectors is to spray the fuel in each engine operating cycle (i.e., a four-stroke cycle) including intake or induction, compression, combustion, and exhaust and output them in the form of command signals to the fuel injectors.

The actuators 11 installed in an inlet system are, for example, an EGR (Exhaust Gas Recirculation) valve which controls the amount of a portion of exhaust gas emitted from the engine 10 to be returned back to an inlet port of the engine 10 (which will also be referred to as an EGR amount below), an operation of a variably-controlled supercharger which regulates the supercharging pressure variably, an operation of a throttle valve which controls the quantity of fresh air to be inducted into the engine 10, and an operation of a valve control mechanism which sets open and close timings of intake and exhaust valves of the engine 10 and regulates the amount of lift of the take and exhaust valves. The ECU 10*a* works to calculate command values representing target controlled variables, i.e., target values of the EGR amount, the supercharging pressure, the quantity of fresh air, the open and close timings, and the amount of lift of the intake and exhaust valves and output them in the form of command signals to the EGR valve, the variably-controlled supercharger, the throttle valve, and the valve control mechanism, respectively.

In the way as described above, the ECU 10*a* controls the operations of the actuators 11 to achieve the target controlled variables, thereby controlling the combustion conditions in the engine 10 to bring the output characteristics of the engine 10 into agreement with desired ones.

The combustion conditions of the engine 10, as referred to above, are defined by a plurality of types of combustion parameters that are ones of, for example, an ignition timing, an ignition delay that is the time required between when the fuel starts to be sprayed and when the fuel starts to be ignited, etc. Such combustion parameters are physical quantities which are usually measured by, for example, a cylinder pressure sensor which measures the pressure in the cylinder of the engine 10.

The output characteristics of the engine 10, as referred to above, are expressed by a plurality of types of engine output-related values that are ones of, for example, a physical quantity associated with exhaust emissions (e.g., the amount of NOx, the amount of PM (Particulate Matter), and the amount of CO or HC), a physical quantity associated with torque outputted from the engine 10 (e.g., the torque of an output shaft of the engine 10) and the speed of the engine 10, a physical quantity associated with a fuel consumption in the engine 10 (e.g., a travel distance per consumed volume of fuel or a consumed volume per running time of the engine 10, as measured through mode running tests, and a physical quantity associated with combustion noise (e.g., engine vibrations or combustion or exhaust noise).

The ECU 10*a* is equipped with a typical microcomputer including a CPU performing operations on given tasks, a RAM serving as a main memory storing therein data produced during the operations of the CPU or results of the operations of the CPU, a ROM serving as a program memory, an EEPROM storing data therein, and a backup RAM to which electric power is supplied at all the time from a backup power supply such as a storage battery mounted in the vehicle even after a main electric power source of the ECU 10*a* is turned off.

The engine 10 has installed therein sensors 12 and 13 which provide outputs to the ECU 10*a*. The sensors 12 are engine output sensors functioning as a portion of an engine output-related value feedback circuit to measure the engine output-related values actually. For example, the engine output sensors 12 are implemented by a gas sensor which measures the concentration of a component (e.g., NOx) of exhaust emissions from the engine 10, a torque sensor which measures the torque outputted by the engine 10, and a noise sensor which measures the magnitude of noise arising from the combustion of fuel in the engine 10. As will be described later, the actual values of the engine output-related values may alternatively be calculated or estimated using algorithmic models without use of the sensor 12.

The sensor 13 are combustion condition sensors serving as a portion of a combustion parameter feedback circuit to determine the combustion parameters actually. For example, the sensors 13 are implemented by a cylinder pressure sensor which measures the pressure in the combustion chamber (i.e., the cylinder) of the engine 10 and an ion sensor which measures the quantity of ion, as produced by the burning of fuel in the engine 10. For example, the ECU 10*a* calculates a change in pressure in the combustion chamber of the engine 10, as measured by the cylinder pressure sensor 13, to determine both the ignition timing and the ignition delay. The actual values of the combustion parameters may alternatively be calculated or estimated using an algorithmic model without use of the sensors 13.

The ECU 10*a* includes a combustion parameter calculator 20, a combustion parameter controller 30, an engine output deviation calculator 40, and a combustion parameter deviation calculator 50. The combustion parameter calculator 20 serves as a combustion target value calculator to determine the combustion conditions of the engine 10 (i.e., target values of the combustion parameters) needed to bring the engine output-related values into agreement with required ones. The combustion parameter controller 30 serves as a controlled variable command calculator to control the operations (i.e., the controlled variables) of the actuators 11 to achieve target combustion conditions of the engine 10. The engine output deviation calculator 40 serves as an engine output feedback circuit to calculate a difference or deviation of an actual value of each of the engine output-related values (i.e., the outputs from the engine output sensors 12) from a required value thereof. The combustion parameter deviation calculator 50 serves as a combustion parameter feedback circuit to calculate a difference or deviation of an actual value of each of the combustion parameters (i.e., the output from the combustion condition sensor(s) 13) from a target value thereof. These circuits 20 to 50 are implemented by function blocks in the microcomputer of the ECU 10*a*.

Specifically, the combustion parameter calculator 20 has a combustion parameter arithmetic expression 22, a feedback controller 23, and a target value calculator 24. The combustion parameter arithmetic expression 22 is stored in a memory such as the ROM of the ECU 10*a*.

The combustion parameter arithmetic expression 22 is made to define correlations between the different types of engine output-related values and the different types of combustion parameters. Specifically, the combustion parameter arithmetic expression 22 is provided by an engine output-to-combustion parameter model, as illustrated in FIG. 1(*a*), or a determinant, as illustrated in FIG. 1(*b*), and to mathematically express relations of the combustion conditions of the engine 10 (i.e., the combustion parameters) to the output conditions of the engine 10 (i.e., the engine output-related values). In other words, the combustion parameter arithmetic expression 22 produces values of the combustion conditions of the engine 10 needed to meet the required values of the engine output-related values. Target values (or reference target values) of the combustion parameters are obtained by substituting required values of the engine output-related values into the combustion parameter arithmetic expression 22.

The combustion parameter calculator 20 having the structure of FIG. 1(*a*) substitutes required values of the combustion parameter arithmetic expression 22 to determine the reference target values of the combustion parameters. The feedback controller 23 calculates a difference or deviation of each of the required values of the engine output-related values from a corresponding one of actual values thereof (i.e., outputs from the engine output sensors 12). Such a deviation will also be referred to as an engine output deviation below. The feedback controller 23 also determines amounts by which the reference target values are to be corrected in the feedback mode in order to eliminate the engine output deviations. The target value calculator 24 then uses the reference target values, as derived by the combustion parameter arithmetic expression 22, and the amounts of correction, as derived by the feedback controller 23, to produce target values of the combustion parameters to be outputted from the combustion parameter calculator 20 for bringing the actual values of the engine output-related values into agreement with the required values, respectively in the feedback mode.

When the engine output deviations become zero (0), the amounts of correction, as derived in the feedback controller 23, will be zero. The reference target values of the combustion parameters calculated by the combustion parameter arithmetic expression 22 are, therefore, outputted from the combustion parameter calculator 20 without being corrected.

The combustion parameter controller 30 includes an integrator 31, a feedback controller 33, and a command value calculator 34. The controlled variable arithmetic expression 32 is stored in a memory (i.e., a storage device) such as the ROM of the ECU 10*a*.

The controlled variable arithmetic expression 32 is made to define correlations between the different types of combustion parameters and the different types of controlled variables. The controlled variable arithmetic expression 32 is provided by a combustion parameter-to-controlled variable model, as illustrated in FIG. 1(*a*), or a determinant, as illustrated in FIG. 1(*c*) and mathematically express values of the controlled variables corresponding to desired combustion conditions of the engine 10. In other words, the controlled variable arithmetic expression 32 provides a combination of values of the controlled variables needed to place the engine 10 in target combustion conditions. The command values (i.e., reference command values) for the controlled variables are, therefore, obtained by substituting target values of the combustion parameters outputted from the target value calculator 24 into the combustion parameter arithmetic expression 32.

The combustion parameter deviation calculator 30 of the structure of FIG. 1(*a*) substitutes the final target values of the combustion parameters into the controlled variable arithmetic expression 32 to derive the reference command values for the controlled variables. The feedback controller 33 calculates a difference or deviation of each of the target values of the combustion parameters from a corresponding one of actual values thereof (i.e., outputs from the combustion condition sensors 13). Such a deviation will also be referred to as a combustion parameter deviation below. The feedback controller 33 also determines amounts by which the reference command values are to be corrected in the feedback mode in order to eliminate the combustion parameter deviations. The command value calculator 34 then uses the reference command values, as derived by the controlled variable arithmetic expression 32, and the amounts of correction, as derived by the feedback controller 33, to produce final command values to be outputted directly to the actuators 11 for bringing the actual values of the combustion parameters into agreement with the target values, respectively in the feedback mode.

When the combustion parameter deviations become zero (0), the amounts of correction, as derived in the feedback controller 33, will be zero. The reference command values calculated by the controlled variable arithmetic expression 32 are, therefore, outputted from the command value calculator 34 to the actuators 11 without being corrected.

Figure 2:
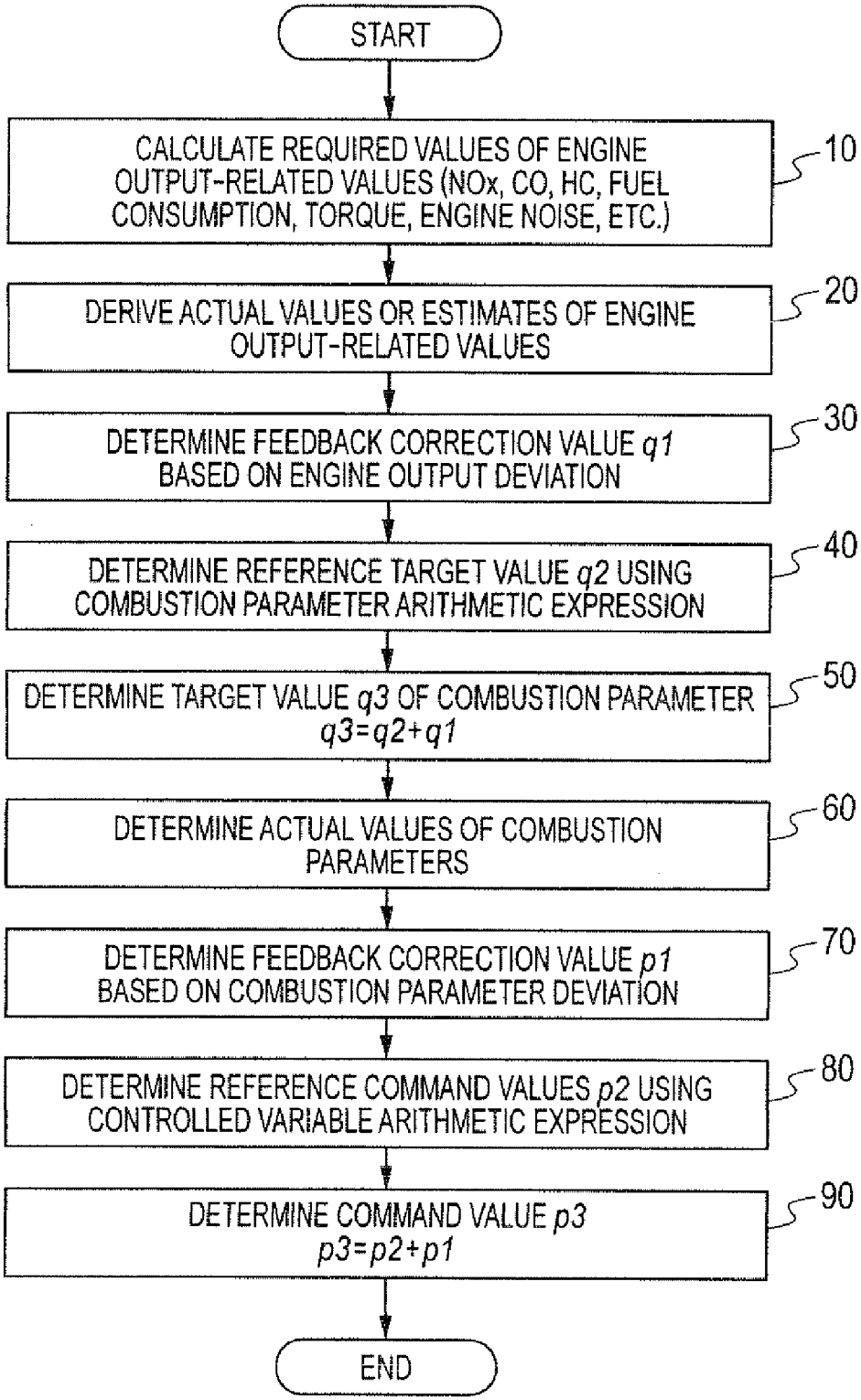
FIG. 2 is a flowchart of an engine control program to be executed by the engine control system of FIG. 1(*a*)

How to calculate the command values to be outputted to the actuators 11 to achieve desired or target values of the controlled variables thereof will be described below with reference to a flowchart of an actuator control program, as illustrated in FIG. 2. This program is to be executed by the microcomputer of the ECU 10*a* at a regular interval (e.g., an operation cycle of the CPU or a cycle equivalent to a given crank angle of the engine 10).

After entering the program, the routine proceeds to step 10 wherein required values of the respective engine output-related values are calculated based on the speed of the engine 10 and the position of the accelerator pedal of the vehicle (i.e., a driver's effort on the accelerator pedal). For example, the ECU 10*a* calculates the required values using a map which is made by the adaptability tests and stores therein optimum values of the engine output-related values in relation to speeds of the engine 10 and positions of the accelerator pedal. The ECU 10*a* may also determine the required values of the engine output-related values as a function of an additional environmental condition or parameter(s) such as the temperature of cooling water for the engine 10, the outside air temperature, and/or the atmospheric pressure.

The routine proceeds to step 20 wherein actual values of the respective engine output-related values are measured from outputs of the engine output sensors 12. The ECU 10*a* may alternatively be designed to estimate or calculate the current engine output-related values through arithmetic models and determine them as the above actual values without use of the engine output sensors 12. Such estimation may be made only on some of the engine output-related values.

The routine proceeds to step 30 wherein the operation of the engine output deviation calculator 40 is executed. Specifically, deviations of the actual values of the engine output-related values measured in step 20 from the required values thereof derived in step 10 (i.e., the engine output deviations) are determined. A feedback correction value q1 is then calculated based on each of the engine output deviations. The correction value q1 may be derived in a known PID (proportional-integral-derivative) algorithm using a proportional term, an integral term, and a derivative term based on the engine output deviation.

The routine proceeds to step 40 wherein the required values of the engine output-related values, as derived in step 10, are substituted into the combustion parameter arithmetic expression 22. Solutions of the combustion parameter arithmetic expression 22 are determined as reference target values q2 of the combustion parameters, respectively. The combustion parameter arithmetic expression 22, as illustrated in FIG. 1(*b*), is so designed that the product of an r-order column vector A1 of variables representing the engine output-related values and a matrix A2 made up of q-by-r elements $a_{11}$ to aqr is defined as a q-order column vector A3 of variables representing the combustion parameters. The required values of the engine output-related values are substituted into the variables of the column vector A1 to derive solutions of the respective variables (i.e., entries) of the column vector A3. The solutions are determined as the reference target values q2 of the combustion parameters.

The routine proceeds to step 50 wherein the operation of the target value calculator 24 is performed. Specifically, each of the feedback correction values q1, as derived in step 40, is added to a corresponding one of the reference target values q2 of the combustion parameters, as derived in step 30, to produce a target value q3 of a corresponding one of the combustion parameters to be outputted finally from the combustion parameter calculator 20.

The routine proceeds to step 60 wherein an output of the combustion condition sensor(s) 13 is monitored to derive actual values of the combustion parameters. The ECU 10*a* may alternatively calculate or estimate current values of the combustion parameters through arithmetic models and determine them as the above actual values without use of the combustion condition sensor 13. Such estimation may be made only on some of the combustion parameters.

The routine proceeds to step 70 wherein the operation of the combustion parameter deviation calculator 50 is performed. Specifically, a deviation of each of the target values q3 of the combustion parameters, as derived in step 50, from a corresponding one of the actual values of the combustion parameters, as derived in step 60, i.e., the combustion parameter deviation is calculated. A feedback correction value p1 is then determined based on each of the combustion parameter deviations. The correction value p1 may be derived in the known PID algorithm using a proportional term, an integral term, and a derivative term based on the combustion parameter deviation.

The routine proceeds to step 80 wherein the target values q3 of the combustion parameters, as derived in step 50, are substituted into the controlled variable arithmetic expression 32. Solutions of the controlled variable arithmetic expression 32 are determined as the reference command values p2 for the controlled variables. The controlled variable arithmetic expression 32, as illustrated in FIG. 1(*c*), is so designed that the product of an q-order column vector A3 of variables representing the combustion parameters and a matrix A4 made up of p-by-q elements $b_{11}$ to bpq is defined as a p-order column vector A5 of variables representing the controlled variables. The target values q3 are substituted into to the variables of the column vector A3 to derive solutions of the respective variables (i.e., entries) of the column vector A5. The solutions are determined as the reference command values p2 of the controlled variables.

The routine proceeds to step 90 wherein the operation of the command value calculator 34 is performed. Specifically, the feedback correction values p1, as derived in step 70, are added to the reference command values p2 for the controlled variables, as derived in step 80, to produce the final command values p3 to be outputted from the ECU 10*a* directly to the actuators 11, respectively.

Examples of the correlations between the engine output-related values and the combustion parameters and between the combustion parameters and the controlled variables, as defined by the combustion parameter arithmetic expression 22 and the controlled variable arithmetic expression 32, will be described below with reference to FIGS. 3(*a*) to 3(*c*).

Figures 3A, 3B, 3C:
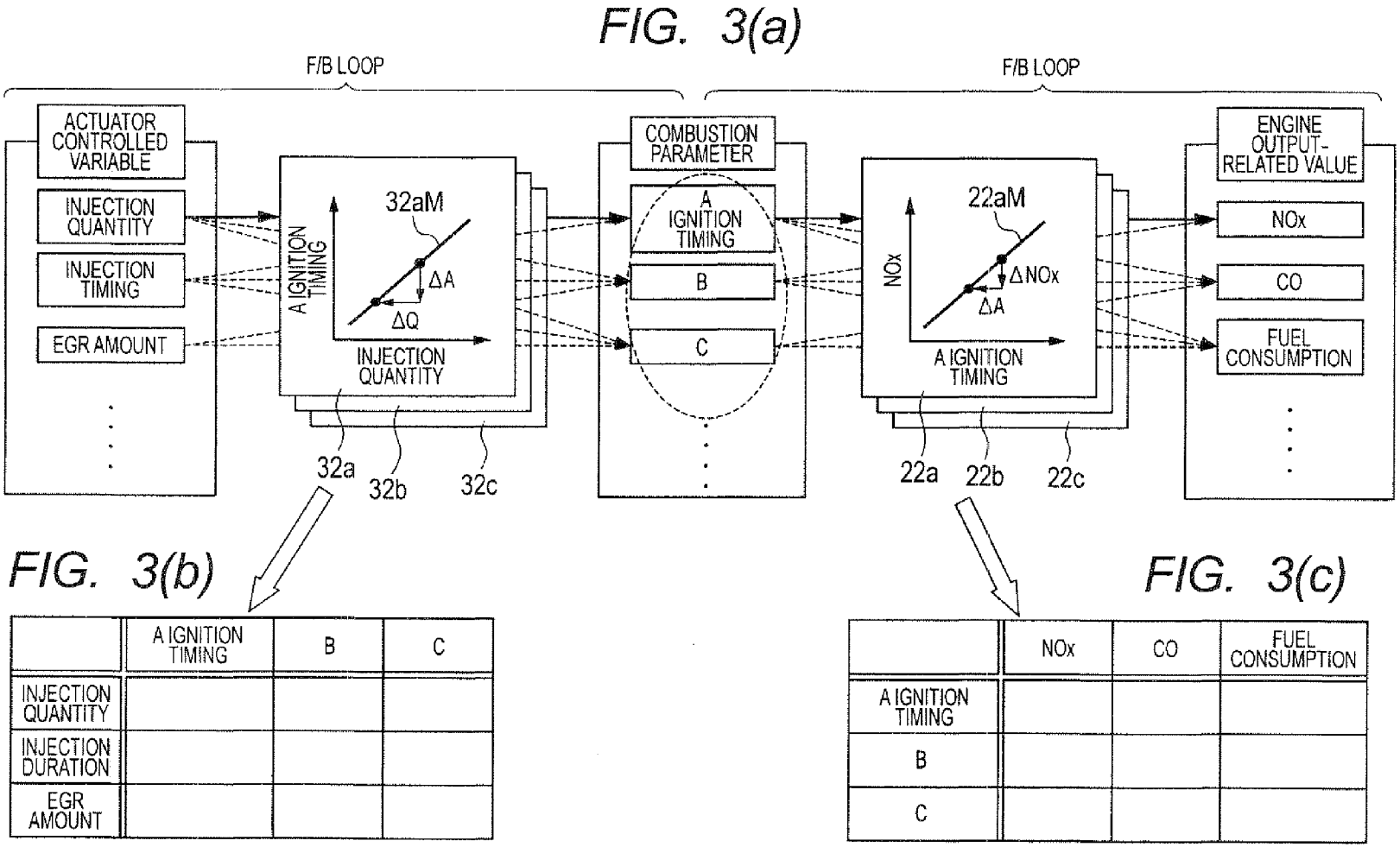
FIG. 3(*a*) is an explanatory view which illustrates correlations, as defined by the combustion parameter arithmetic expression and is the controlled variable arithmetic expression in FIGS. 1(*a*) to 1(*c*)

FIG. 3(*a*) illustrates the above correlations schematically. The injection quantity, the injection duration, and the EGR amount are defined as the controlled variables of the actuators 11. The amount of NOx, the amount of CO, and the fuel consumption are defined as the engine output-related values. "A", "HB", and "C" represent the different types of combustion parameters, respectively. For instance, "A" indicates the ignition timing in the engine 10.

In the example of FIG. 3(*a*), reference number 32*a* denotes a regression line 32*a*M which represents a correlation between the injection quantity and the combustion parameter A. The regression line 32*a*M is set up by, for example, the multiple regression analysis. Similarly, reference number 32*b* denotes a regression line which represents a correlation between the injection quantity and the combustion parameter B. Reference number 32*c* denotes a regression line which represents a correlation between the injection quantity and the combustion parameter C. Specifically, the correlation, as illustrated in FIG. 3(*b*), between each of the injection quantity, the injection timing, and the EGR amount and one of the combustion parameters A, B, and C is defined by the regression line through the model or the determinant, as described above. Therefore, when combinations of values of the injection quantity, the injection timing, and the EGR amount are specified, corresponding combinations of values of the combustion parameters A, B, and C are obtained. In other words, relations of the controlled variables to the combustion conditions of the engine 10 (i.e., the combustion parameters) are defined. The controlled variable arithmetic expression 32 is, as can be seen in FIG. 1(*a*), defined by a model inverse of that in FIG. 3(*a*).

In FIG. 3(*a*), reference number 22*a* denotes a regression line 22*a*M which represents a correlation between the combustion parameter A and the amount of NOx. The regression line 22*a*M is set up by, for example, multiple regression analysis. Similarly, reference number 22*b* denotes a regression line which represents a correlation between the combustion parameter A and the amount of CO. Reference number 22*c* denotes a regression line which represents a correlation between the combustion parameter A and the fuel consumption. Specifically, the correlation, as illustrated in FIG. 3(*c*), between each of the combustion parameters A, B, and C and one of the amount of NOx, the amount of CO, and the fuel consumption is defined by the regression line through the model or the determinant, as described above. Therefore, when combinations of the combustion parameters A, B, and C are specified, corresponding combinations of the amount of NOx, the amount of CO, and the fuel consumption are obtained. In other words, relations of the combustion conditions of the engine 10 (i.e., the combustion parameters) to the output conditions of the engine 10 (i.e., the engine output-related values) are defined. The combustion parameter arithmetic expression 22 is, as can be seen in FIG. 1(*a*), defined by a model inverse of that in FIG. 3(*a*).

The combustion parameter arithmetic expression 22, as described already, defines the combinations of the engine output-related values and the combustion parameters, thus enabling changes in the respective engine output-related values in response to a change in one of the combustion parameters to be figured out. For instance, when actual values of the amount of NOx and the amount of PM deviate from required values thereof, respectively, as demonstrated in FIG. 4, such deviations are eliminated by changing the latest value of the ignition timing A1 (i.e., the value, as derived one program execution cycle earlier) to the value A2. Even if the value of the ignition timing A needed to bring the amount of NOx and the amount of PM just into agreement with the required values thereof is not found, optimum values which bring both the amount of NOx and the amount of PM as closer to the required values, respectively, as possible may be derived by the combustion parameter arithmetic expression 22.

Figure 4:
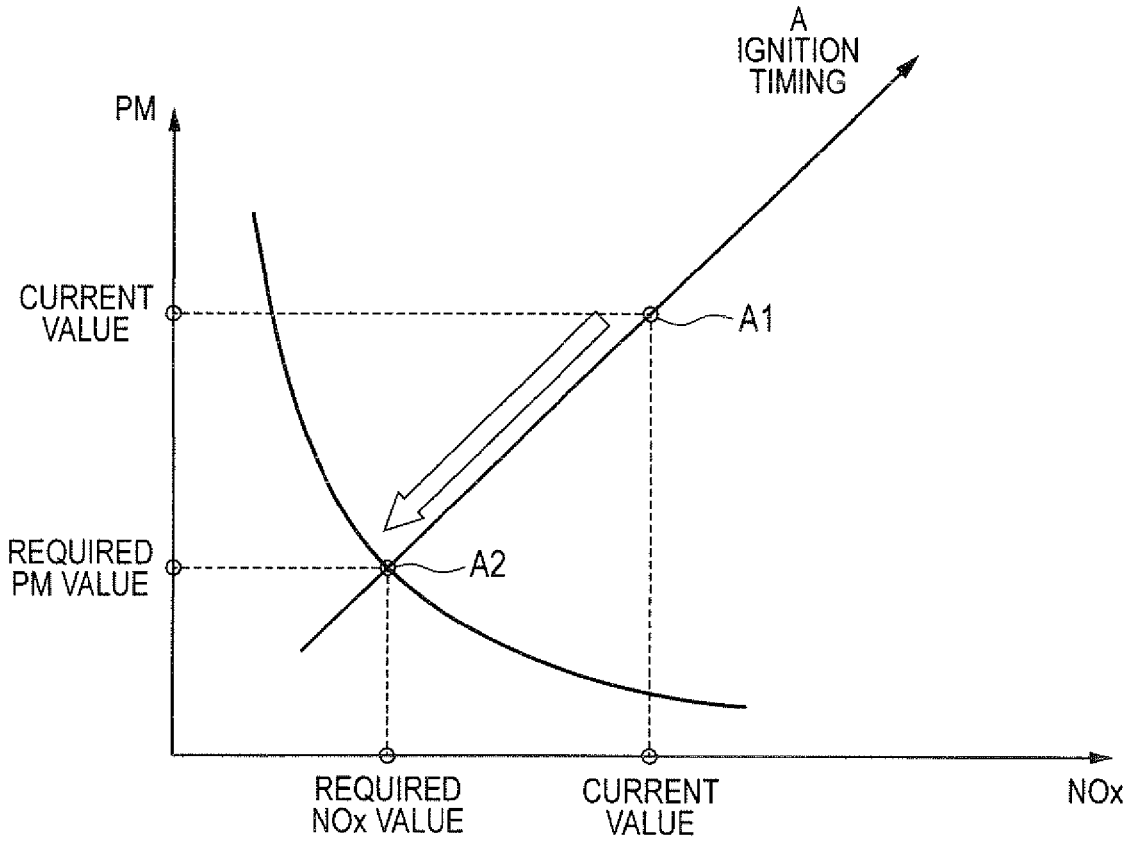
FIG. 4 is an explanatory view which represents effects of a combustion parameter on engine output-related values.
Figure 5A:
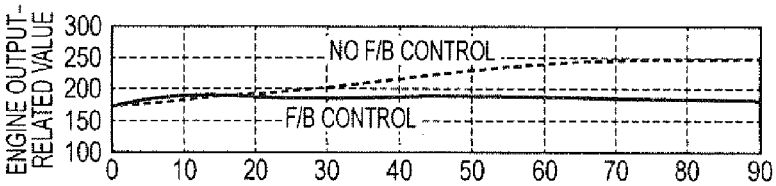
FIG. 5(*a*) is a view which exemplifies a change in engine output-related value.
Figure 5B:
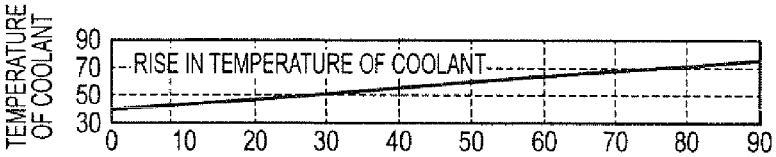
Figure 5C:
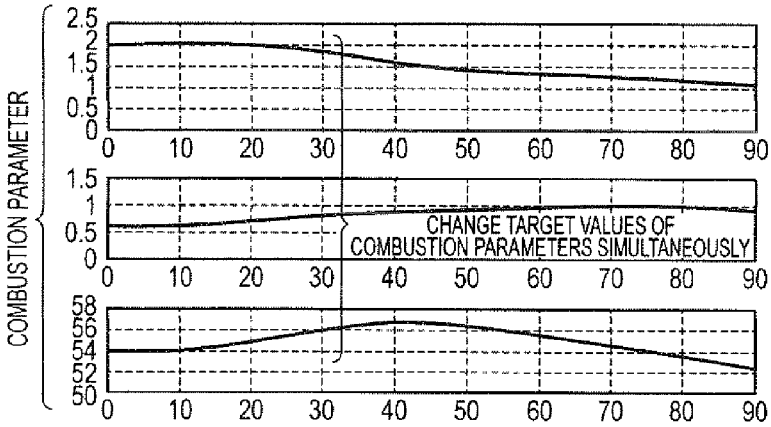
Figure 5D:
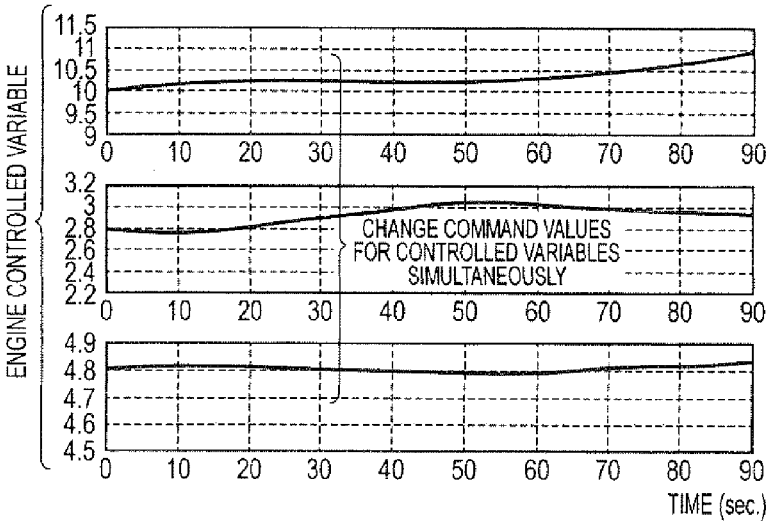

FIG. 4 is a schematic view which demonstrates the correction of only the ignition timing A for the sake of convenience, but however, the combustion parameter arithmetic expression 22 is, as described above, provided to define a given number or all possible combinations of the different types of engine output-related values and the different types of combustion parameters, thus causing the target values of the combustion parameters to be corrected simultaneously in response to one or some of the deviations of the engine output-related values.

Like the combustion parameter arithmetic expression 22, the controlled variable arithmetic expression 32 is prepared to define a given number or all possible combinations of the different types of combustion parameters and the different types of controlled variables, thus causing the command values for the controlled parameters to be corrected simultaneously in response to one or some of the deviations of the combustion parameters.

FIGS. 5(*a*) to 5(*d*) are timing diagrams which demonstrate results of simulations of operations of the engine control system of this embodiment when the temperature of cooling water (i.e., an environmental condition) for the engine 10 has changed during a steady operation of the engine 10.

When the temperature of cooling water is, as illustrated in FIG. 5(*b*), increased gradually, it will cause the combustion conditions of the engine 10 to change even if the controlled variables remain unchanged. The combustion parameter deviation calculator 50 then outputs the combustion parameter deviations. The engine control system changes the current values of the controlled variables in the feedback mode so as to minimize or eliminate the combustion parameter deviations, as derived by the combustion parameter deviation calculator 50. In the illustrated example, the engine control system corrects, as illustrated in FIG. 5(*d*), the current values of the controlled variables simultaneously in response to the change in temperature of cooling water, so that the operations of the actuators 11 are controlled simultaneously in a coordinated way to minimize the combustion parameter deviations as a whole.

Additionally, when the temperature of cooling water is increased gradually, it will also cause the engine output-related values to change even if the combustion conditions of the engine 10 remain unchanged. The engine output deviation calculator 40 then outputs the engine output deviations. The engine control system changes the target values of the combustion parameters in the feedback mode so as to minimize or eliminate the engine output deviations, as derived by the engine output deviation calculator 40. In the illustrated example, the engine control system corrects, as illustrated in FIG. 5(*c*), the target values of the different types of combustion parameters simultaneously in a coordinated way in response to the change in temperature of cooling water to minimize the engine output deviations as a whole.

In short, the engine control system, as illustrated in FIGS. 5(*d*) and 5(*c*), regulates the controlled variables simultaneously and also regulates the combustion parameters simultaneously in the feedback mode to bring the engine output-related value, as indicated by a solid line in FIG. 5(*a*), into agreement with a fixed value. In the case where the engine control system is designed not to perform the above feedback control, for example, to perform open-loop control using an adaptability test-made map representing one-to-one correspondences between the different types of engine output-related values and the different types of controlled variables, the engine output-related value changes, as indicated by a broken line in FIG. 5(*a*), in response to a change in temperature of cooling water for the engine 10. The results of the simulations in FIGS. 5(*a*) to 5(*d*) show that the above feedback control in this embodiment improves the robustness of the engine control system.

The ECU 10*a*, as described above, works to control the command values for the controlled variables of the actuators 11 based on the combustion parameters, as derived by the combustion parameter deviation calculator 50, in the feedback mode. The ECU 10*a* corrects or updates the elements $b_{11}$ to bpq of the matrix A4 of the controlled variable arithmetic expression 32 as a function of the combustion parameter deviations in order to shorten a control time required to bring the actual values of the combustion parameters into agreement with the target values. This is very effective, especially in the case where the combustion parameter deviations have occurred due to aging or mechanical wear of sliding parts of the actuators 11.

The correlations between the engine output-related values and the combustion parameters, as defined by the combustion parameter arithmetic expression 22, is heavily dependent upon the characteristics of the engine 10, but less dependent upon a change in environmental condition. The inventors of this application focused their attention on such a dependency difference and designed the engine control system to learn or update the controlled variable arithmetic expression 32 based on actual values of the combustion parameters, as measured by the combustion condition sensors 13 without updating the combustion parameter arithmetic expression 22.

How to learn the controlled variable arithmetic expression 32 will be described below with reference to a flowchart of a learning program in FIG. 6. This program is to be executed by the microcomputer of the ECU 10*a* at a regular interval (e.g., an operation cycle of the CPU or a cycle equivalent to a given crank angle of the engine 10). In other words, the ECU 10*a* serves as a learning circuit to optimize the correlations between the combustion parameters and the controlled variables for the actuators 11, as defined by the controlled variable arithmetic expression 32.

After entering the program, the routine proceeds to step 100 wherein it is determined whether the engine 10 is running in a steady state or not. Specifically, it is determined whether a rate of change (i.e., a change per unit time) in output from the combustion condition sensor(s) 13 is less than a given value or not. If a YES answer is obtained meaning that the rate of change is less than the given value, it concludes that the engine 10 is running in the steady state.

The routine then proceeds to step 110 wherein it is determined whether the time elapsed since calibration of the combustion condition sensor(s) 13 is completed is within a predetermined time limit or not. For example, in the case where the cylinder pressure sensor, as described above, is used as the combustion condition sensor 13, it is so calibrated as to minimize a deviation of an actual output of the combustion condition sensor 13 which is sampled in a condition where the pressure in the cylinder of the engine 10 is expected to be the atmospheric pressure from the atmospheric pressure, e.g., upon turning on of the ignition switch immediately before the start of the engine 10.

In short, a sequence of learning steps 120 and 140 are commenced within the predetermined time limit since the completion of calibration of the combustion condition sensor 13 when the engine 10 is running in the steady state. If a NO answer is obtained in either of step 100 or 110, then the routine terminates.

If a YES answer is obtained in step 110, then the routine proceeds to step 120 wherein the command values for the controlled variables of the actuators 11, as outputted from the command value calculator 34, and actual values of the combustion parameters, as determined through the combustion parameter sensor 13, are sampled.

The routine proceeds to step 130 wherein it is determined whether a sufficient number of samples of the command values and the actual values of the combustion parameters have been obtained and stored or not. "The sufficient number" will be explained later in detail.

If a NO answer is obtained in step 130, then the routine returns back to step 120. Alternatively, if a YES answer is obtained, then the routine proceeds to step 140 wherein the controlled variable arithmetic expression 32 is optimized using learning techniques. Specifically, entries (i.e., elements) of the controlled variable arithmetic expression 32 are corrected and updated in the manner, as described below. Note that if a NO answer is obtained in step 130, then the routine may terminates without returning back to step 120.

For example, in the case where the controlled variable arithmetic expression 32 has the structure, as illustrated in FIG. 1(*c*), the entries of the matrix A4 are updated. This updating is achieved by substituting the command values for the controlled variables and the actual values of the combustion parameters, as derived in step 130, into the column vectors A5 and A3, respectively, to alter the elements in the matrix A4.

The matrix A4 is, as described above, constructed by the q-by-r elements $a_{11}$ to aqr. q-by-r simultaneous equations are, thus, needed to obtain one solution for q-by-r variables. Accordingly, it is necessary to obtain the number of samples through steps 120 and 130 which is enough to derive one solution for all the elements of the matrix A4.

The engine control system of this embodiment offers the following advantages.

1) The corrections between the controlled variables of the actuators 11 and the engine output-related values, as defined by the controlled variable arithmetic expression 32, usually change with a change in environmental condition, such as the temperature of coolant for the engine 10 or the temperature of outside air, or due to individual variability in characteristic or aging of the engine 10, while the correlations between the engine output-related values and the combustion parameters, as defined by the combustion parameter arithmetic expression 22 is heavily dependent upon the characteristics of the engine 10, but less dependent upon the change in environmental condition. The inventors of this application focused their attention on such a dependency difference between the controlled variable arithmetic expression 32 and the combustion parameter arithmetic expression 22 and designed the engine control system to learn the actual values of the combustion parameters, as measured by the combustion condition sensors 13, to update the structural elements of the controlled variable arithmetic expression 32. This improves the accuracy in determining the controlled variables of the actuators 11 through the controlled variable arithmetic expression 32 which is sensitive to a change in environmental conditions and ensures the stability in bringing the engine output-related values into agreement with required values in the feedback control operation of the engine control system.

2) In the case where one of the engine output-related values is detected by the NOx sensor (i.e., the engine output sensor 12) to learn the correlations between that engine output-related value and the controlled variables, such learning needs to be done only in the condition where the NOx sensor is sufficiently sensitive to a change in concentration of NOx in emissions from the engine 10, for example, when the engine 10 is running in the steady state because the responsiveness of the NOx sensor is usually low. Additionally, it costs so much to learn all the correlations. In contrast, it is usually faster to detect the combustion parameters using the combustion condition sensor 13 in lots of learnable conditions. It is also easy to learn all the correlations between the controlled variables and the combustion parameters. The learning of the controlled variable arithmetic expression 3 is very effective in ensuring the accuracy in brining the engine output-related values into agreement with required values in the feedback control operation of the engine control system.

3) The learning of the controlled variable arithmetic expression 32 using the output from the combustion condition sensor(s) 13 is, as described above, made when a learning condition is met, i.e., the engine 10 is running in the steady state. This avoids the deterioration of the learning accuracy due to the lag in response or variation in output of the combustion condition sensor.

4) The learning of the controlled variable arithmetic expression 32 is, as described above, commenced within the given period of time after the completion of calibration of the combustion condition sensor(s) 13, thus avoiding the deterioration of the learning accuracy due to an error in output of the combustion condition sensor 13 which would appear before the calbuation.

5) The combustion parameter arithmetic expression 22 is designed to define the correlations between the different types of engine output-related values and the different types of combustion parameters, thereby figuring out how to control the combustion conditions of the engine 10 to achieve the required engine output-related values. Specifically, the engine control system works to determine a combination of target values of the combustion parameters through the combustion parameter arithmetic expression 22 so as to minimize the deviations of actual values of the engine output-related values from required values thereof and realize the required engine output-related values in view of the fact that the different types of combustion parameters mutually interfere with one of the engine output-related values. This results in improvement in bringing the engine output-related values closer to the required values simultaneously.

6) The controlled variable arithmetic expression 32 is designed to define the correlations between the different types of combustion parameters and the different types of controlled variables, thereby figuring out how to control the combustion conditions of the engine 10 to achieve desired output conditions of the engine 10. Specifically, the engine control system works to determine a combination of the controlled variables through the controlled variable arithmetic expression 32 so as to minimize the deviations of actual values of the combustion parameters from target values thereof, thereby avoiding the deterioration of engine controllability arising from the mutual interference of the different types of controlled variables with one of the combustion parameters. This results in improvement in bringing the combustion parameters closer to the target values simultaneously.

7) The engine control system, as described above, has the combustion parameter arithmetic expression 22 and the controlled variable arithmetic expression 32 for use in selecting a combination of target values of the combustion parameters required to achieve required values of the engine output-related values and a combination of command values for the controlled variables needed to achieve target values of the combustion parameters, thereby eliminating the adaptability tests to find optimum values of such combinations, respectively, which results in a reduction in burden of the adaptability test work and the map-making work on the control system manufacturer and also permits the capacity of the memory needed to store the maps in the ECU 10*a* to be decreased.

Particularly, the acquisition of optimum values of the above combinations for each of the environmental conditions through the adaptability tests usually results in a great increase in number of the adaptability tests. The engine control system of this embodiment, however, improves the robustness against a change in environmental condition, as already discussed in FIGS. 5(*a*) to 5(*d*), through the feedback control, as described below in 4) and 5), thus eliminating the need for preparing the combustion parameter arithmetic expression 22 and the controlled variable arithmetic expression 32 for each of the environmental conditions, which also reduces the burden on the control system manufacturers.

8) The engine control system sets the controlled variables of the actuators 11 simultaneously in the coordinated manner so as to bring actual or calculated values of the control parameters into agreement with target values thereof in the feedback modes, thereby minimizing deviations of the different types of combustion conditions of the engine 10 from target conditions which arise from a change in environmental condition such as the temperature of cooling water for the engine 10. This improves the robustness of the combustion parameter controller 30 against the change in environmental condition in controlling the combustion conditions of the engine 10.

When the function of learning the controlled variable arithmetic expression 32 (i.e., step 140 in FIG. 6) is performed properly, it will result in no deviation of actual values of the combustion parameters, as determined by the combustion parameter sensor 13, from target values thereof. The learning can't, however, always be made at all times. The risk of erroneous learning is also increased depending upon conditions to start the learning. Therefore, the engine control system of this embodiment starts to learn the controlled variable arithmetic expression 32, as described above, only when the condition in which the risk of the erroneous learning is low is met. This keeps good ability of the engine control system of this embodiment.

9) The engine control system sets the target values of the different types of combustion parameters simultaneously in the coordinated manner so as to bring actual or calculated values of the engine output-related values into agreement with required values thereof in the feedback modes, thereby minimizing deviations of the different types of engine output-related values from the target values which arise from a change in environmental condition such as the temperature of cooling water for the engine 10. This improves the robustness of the combustion parameter calculator 20 against the change in environmental condition in calculating the target values of the combustion parameters needed to meet the required values of the engine output-related values.

The corrections representing the combustion conditions of the engine 10 (i.e., the combustion parameters) needed to bring the output conditions of the engine 10 (i.e., the engine output-related values) is less dependent upon a change in environmental condition such as the temperature of coolant for the engine 10 or the temperature of outside air, but may be changed by the individual variability or aging of the engine 10. The engine control system is, therefore, designed to feed actually measured or calculated values of the engine output-related values back to the calculation of target values of the combustion parameters needed to achieve required values of the engine output-related values. This ensures good controllability of the engine control system.

10) The improvement of the robustness against a change in environmental condition eliminates the need for reflecting the environmental condition, as measured by, for example, a coolant temperature sensor, in controlling the engine 10. This permits one or more environmental condition sensors to be omitted.

11) Usually, it is very complicated to define the correlations between the different types of engine output-related values and the different types of controlled variables of the actuators 11 directly. In other words, it is very difficult to find the regression lines 32*a*M, as illustrated in FIG. 3(*a*), experimentally. It is, however, relatively easy to obtain the correlations between the engine output-related values and the combustion parameters and between the combustion parameters and the controlled variables of the actuators 11. In light of this fact, the engine control system of this embodiment uses the combustion parameter arithmetic expression 22 and the controlled variable arithmetic expression 32 to define the correlations between the engine output-related values and the controlled variables through the combustion parameters as intermediate parameters, thereby facilitating the ease of acquiring data on the regression lines 22*a*M and 32*a*M used in making the combustion parameter arithmetic expression 22 and the controlled variable arithmetic expression 32.

12) The engine control system works to control the actual or calculated values of the engine output-related values in the feedback mode where the combustion parameters are employed as the intermediate parameters and also to control actual or calculated values of the intermediate parameters (i.e., the combustion parameters) in the feedback mode, thus resulting in improved robustness against a change in environmental condition in controlling the engine 10 through the combustion parameter controller 30 and the combustion parameter calculator 20.

13) If one of the actuators 11 has failed to operate properly, so that it has become impossible to change a corresponding one of the controlled variables, the engine control system controls the actual or calculated values of the combustion parameters in the feedback mode, so that the command values for the controlled variables continue to be corrected until the combustion parameter deviations become zero (0). This causes the other controlled variables for the actuators 11 operating properly to be adjusted in the coordinated manner to bring the actual values of the combustion parameters into agreement with the target values, thereby bringing the engine output-related values close to the required values, respectively.

Figure 7:
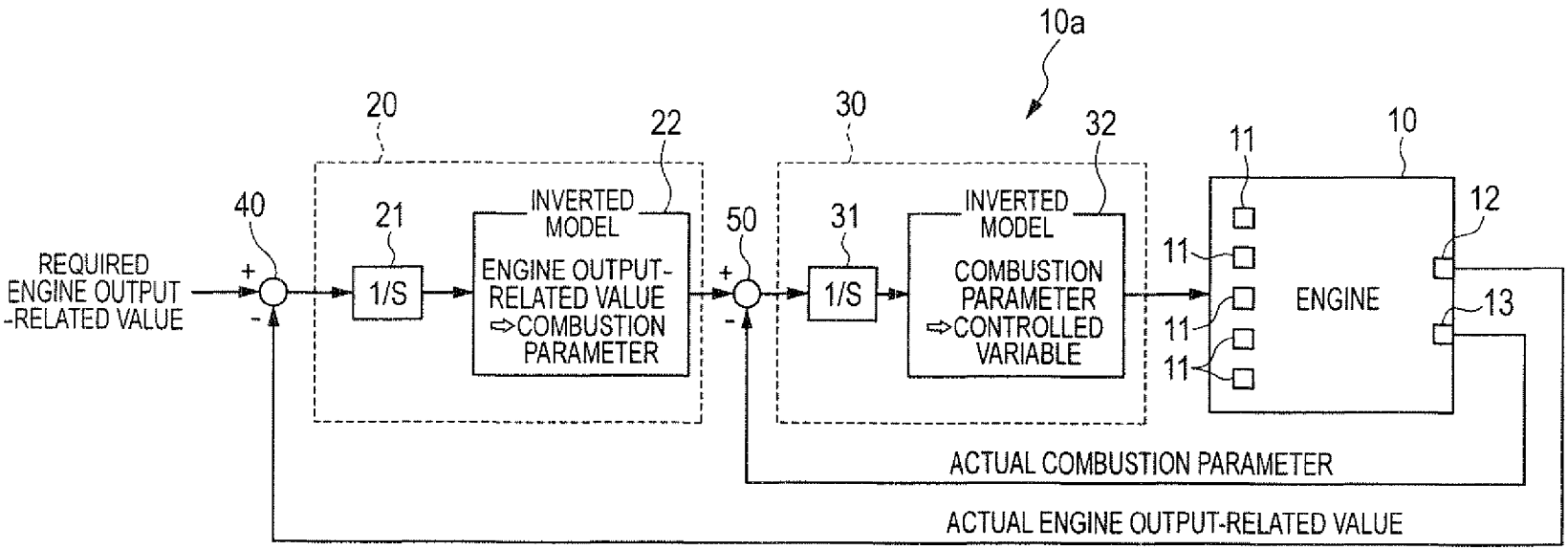
FIG. 7 is a block diagram which shows an engine control system according to the second embodiment.

FIG. 7 illustrates an engine control system of the second embodiment of the invention. The same reference numbers as employed in the first embodiment will refer to the same parts, and explanation thereof in detail will be omitted here.

The engine control system of the first embodiment is, as described above, designed to determine solutions, as derived by substituting target values of the combustion parameters into the controlled variable arithmetic expression 32, as the reference command values p2, calculate the feedback correction values p1 based on the combustion parameter deviations through the feedback controller 33, and compute the command values p3 (=p1+p2) to be outputted to the actuators 11 based on the reference command values p2 and the feedback control values p1 through the command value calculator 34. In contrast, the engine control system of the second embodiment in FIG. 7 substitutes the is combustion parameter deviations into the controlled variable arithmetic expression 32 and uses resulting solutions as target changes p2 in the command values which represent amounts by which the current values of the controlled variables are to be changed. The engine control system also determines values which are prepared as a function of an engine operating condition such as the speed of the engine 10 as the reference command values p1 for the controlled variables. This brings actual values of the combustion parameters into agreement with target values thereof in the feedback control operation of the ECU 10*a*.

The reference command values p1 may be calculated in the ECU 10*a* according to a mathematical formula or by look-up using a map as a function of the operating condition of the engine 10. The map is, unlike those taught in Japanese Patent First Publication Nos. 2008-223643 and 2007-77935 referred to in the introductory part of this application, made to provide only the reference command values p1 and thus easy to make with fewer adaptability tests. Each of the command values p3 that is the sum of a corresponding one of the reference command values p1 and a corresponding one of the target change p2 is produced as being outputted directly to a corresponding one of the actuators 11.

The combustion parameter controller 30 also includes an integrator 31 which works to sum or totalize the deviation of the actual value of each of the combustion parameters from the target value thereof, as derived by the combustion parameter deviation calculator 50, and input it into the controlled variable arithmetic expression 32. This minimizes the possibility that the actual values of the combustion parameters will deviate from the target values thereof constantly. When the total value of each of the deviations, as derived by the integrator 31, becomes zero (0), a corresponding value, as calculated by the controlled variable arithmetic expression 32, will be zero. The command value for each of the controlled variables is, therefore, so set as to keep the latest value of the controlled variable as it is.

The engine control system of the first embodiment determines solutions, as derived by substituting required values of the engine output-related values into the combustion parameter arithmetic expression 22, as the reference target values q2, calculates the feedback correction values q1 based on the engine output deviations through the feedback controller 23, and computes the target values q3 (=q1+q2) of the combustion parameters to be outputted from the combustion parameter calculator 20 based on the reference target values q2 and the feedback control values q1 through the target value calculator 24. In contrast, the engine control system of the second embodiment in FIG. 7 substitutes the engine output deviations into the combustion parameter arithmetic expression 22 and uses resulting solutions as target changes q2 in target values of the combustion parameters which represent amounts by which the current combustion conditions of the engine 10 (i.e., the current values of the combustion parameters) are to be changed. The engine control system also determines values which are prepared as a function of an engine operating condition such as the speed of the engine 10 as the reference target values q1 of the combustion parameters. This brings actual values of the engine output-related values into agreement with required values thereof in the feedback control operation of the ECU 10*a*.

The reference target values q1 may be calculated in the ECU 10*a* according to a mathematical formula or by look-up using a map as a function of the operating condition of the engine 10. The map is designed to provide only the target values q1 and thus easy to make with fewer adaptability tests. Each of the target values q3 that is the sum of a corresponding one of the reference target values q1 and a corresponding one of the target change q2 is produced as being outputted directly to the combustion parameter deviation calculator 50.

The combustion parameter calculator 20 also includes an integrator 21 which works to sum or totalize the deviation of the actual value of each of the engine output-related values from the required value thereof, as derived by the engine output deviation calculator 40, and input it into the combustion parameter arithmetic expression 22. This minimizes the possibility that the actual values of the engine output-related values will deviate from the required values thereof constantly. When the total value of each of the deviations, as derived by the integrator 21, becomes zero (0), a corresponding value, as calculated by the combustion parameter arithmetic expression 22, will be zero. Each of the combustion parameters is, therefore, so set as to keep the latest value thereof as it is.

The engine control system of the second embodiment serves to control the combustion parameters and the actual or calculated values of the engine output-related values in the same coordinated feedback mode as in the first embodiment.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For example, some of the features in the first and second embodiments are combined or omitted to design the engine control system.

Figure 6:
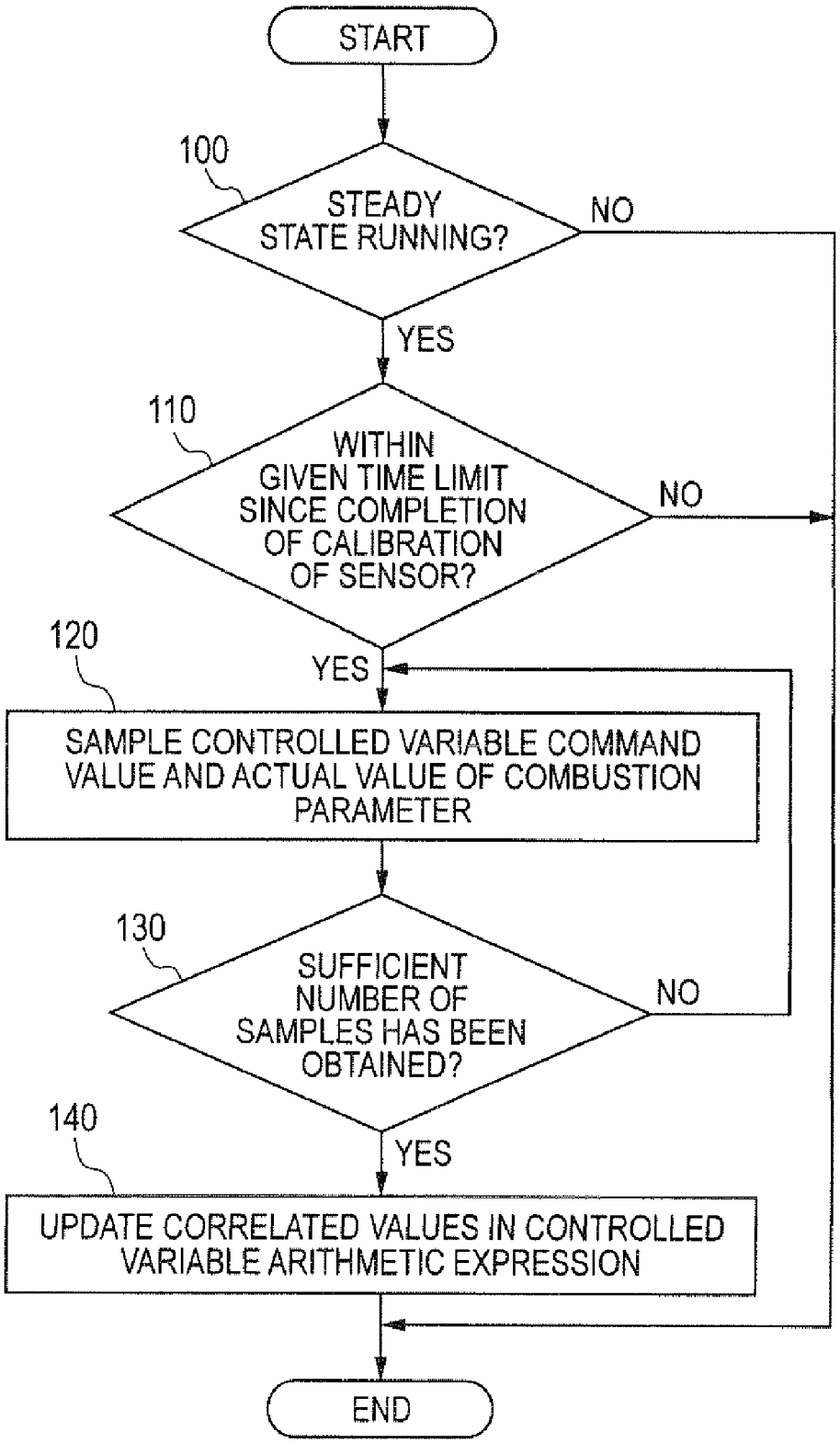
FIG. 6 is a flowchart of a program to learn or optimize a controlled variable arithmetic expression used in the engine control system of FIG. 1.

Step 100 of FIG. 6 in which it is determined whether the engine 10 is running in the steady state or not may be omitted. In other words, the command values for the controlled variables of the actuators 11 and the actual values of the combustion parameters may also be sampled to optimize or update the controlled variable arithmetic expression 32 when the engine 10 is running in a transient state. In this case, it is preferable that a greater weighting factor is used in updating the controlled variable arithmetic expression 32 using the command values and the actual values of the combustion parameters, as sampled when the engine 10 is running in the steady state, while a smaller weighting factor is used in updating the controlled variable arithmetic expression 32 using the command values and the actual values of the combustion parameters, as sampled when the engine 10 is running in the transient state.

The elements or entries in the matrix A4 may be optimized using a weighting factor in the following manner. A deviation of each of the values derived in step 140 of FIG. 6 for use in updating the entries of the matrix A4 from a corresponding one of the entries in the matrix A4. Next, each of the deviations is multiplied by a predetermined weighting factor w to produce a correction value. The correction value is added to a corresponding one of the entries in the matrix A4 to update the one of the entries. The weighting factor w may have a greater value for use in optimizing the controlled variable arithmetic expression 32 using the command values and the actual values of the combustion parameters, as sampled when the engine 10 is running in the steady state, while it may have a smaller value for use in optimizing the controlled variable arithmetic expression 32 using the command values and the actual values of the combustion parameters, as sampled when the engine 10 is running in the transient state.

The determination in step 110 of FIG. 6 as to whether the time elapsed after the completion of calibration of the combustion condition sensor(s) 13 is within the predetermined time limit or not may be omitted. Thus, the learning may also be made after the lapse of the predetermined time limit. In this case, it is preferable that a greater weighting factor is used in updating the controlled variable arithmetic expression 32 using the command values and the actual values of the combustion parameters, as sampled within the predetermined time limit, while a smaller weighting factor is used in updating the controlled variable arithmetic expression 32 using the command values and the actual values of the combustion parameters, as sampled after the lapse of the predetermined time limit.

The engine control system of either of the first and second embodiments may alternatively be designed to learn or optimize the combustion parameter arithmetic expression 22 in addition to the controlled variable arithmetic expression 32.

The combustion parameter arithmetic expression 22 may be optimized by using all or some of actual values of the engine output-related values, as derived by the engine output sensors 12. Similarly, the controlled variable arithmetic expression 32 may also be optimized by using all or some of actual values of the combustion parameters, as derived by the combustion condition sensor(s) 13.

The engine control system in each of the first and second embodiments controls the actual or calculated values of the combustion parameters and the engine output-related values in the feedback mode, however, may alternatively be designed to control at least one of the former and the latter in the open-loop mode. For instance, the feedback controller 23, the target value calculator 24, and the engine output deviation calculator 40, as illustrated in FIG. 1, are omitted. The engine control system outputs the reference target values, as derived by the combustion parameter arithmetic expression 22, directly to the combustion parameter controller 30. Alternatively, the feedback controller 33, the command value calculator 34, and the combustion parameter deviation calculator 50 are omitted. The engine control system outputs the reference command values, as derived by the controlled variable arithmetic expression 32, directly to the actuators 11.

The engine control system in each of the first and second embodiments may be constructed to replace the combustion parameter arithmetic expression 22 with a map in which optimum values of the combustion parameters are stored for each of the required values of the engine output-related values.

What is claimed is:

1. An engine control apparatus that controls operations of actuators to control combustion conditions in an engine, thereby controlling output characteristics of the engine, comprising:

a combustion target value calculator that uses a combustion parameter arithmetic expression that defines correlations between engine output values indicating output characteristics of the engine and combustion parameters associated with combustion conditions of the engine to calculate target values of combustion parameters for bringing engine output values into agreement with required values;

a controlled variable command value calculator that uses a controlled variable arithmetic expression defining correlations between a plurality of types of combustion parameters and a plurality of types of controlled variable for the actuators to calculate combinations of command values of the plurality of types of controlled variables for bringing the plurality of types of combustion parameters into agreement with target values;

a combustion condition determiner that determines actual values of the plurality of combustion parameters; and a controlled variable arithmetic expression learning circuit that performs a learning operation to learn said controlled variable arithmetic expression based on the command values of the plurality of types of controlled variables, as calculated by said controlled variable command value calculator, and the values detected by said combustion condition determiner that are accumulated in a number of times required to obtain resolutions of said controlled variable arithmetic expression.

2. An engine control apparatus as set forth in claim 1, wherein execution of leaning by said controlled variable arithmetic expression learning circuit is permitted in a steady-state condition where a rate of change in the value detected by said combustion condition determiner is stable within a given value, while it is prohibited in a transient state where said rate of change is greater than or equal to the given value.

3. An engine control apparatus as set forth in claim 1, wherein learning executed by said controlled variable arithmetic expression leaning circuit in a state-state condition where a rate of change in the value detected by said combustion condition determiner is stable within a given value is set greater in weighting than that executed by said controlled variable arithmetic expression learning circuit in a transient state where said rate of change is greater than or equal to the given value.

4. An engine control apparatus as set forth in claim 1, wherein execution of learning by said controlled variable arithmetic expression learning circuit is permitted in a time interval between completion of calibration of the combustion condition determiner executed during running of the engine and when a given period of time passes since the completion of calibration and is prohibited after the time interval expires.

5. An engine control apparatus as set forth in claim 1, wherein said combustion condition determiner is a cylinder pressure sensor which measures a pressure in a cylinder of the engine.

6. An engine control apparatus as set forth in claim 1, further comprising a combustion parameter feedback circuit that feeds deviations of the actual values detected by said combustion condition determiner from the target values of the combustion parameters back to calculation of the command values of the controlled variables.

7. An engine control apparatus as set forth in claim 1, wherein said combustion parameter arithmetic expression defines correlations between the plurality of types of engine output values and the plurality of types of combustion parameters, and wherein said combustion target value calculator calculates combinations of target values of the plurality of types of combustion parameters with the required values of the plurality of types of engine output values based on the required values and said combustion parameter arithmetic expression.

8. An engine control apparatus as set forth in claim 1, further comprising an engine output feedback circuit that feeds deviations of the actual values or calculated values of the engine output values from the required values of the engine output values back to calculation of the target values of said combustion parameters.

* * * * *